US005269151A

United States Patent [19]

Dinh

[11] Patent Number: 5,269,151

[45] Date of Patent: Dec. 14, 1993

[54] PASSIVE DEFROST SYSTEM USING WASTE HEAT

[75] Inventor: Khanh Dinh, Alachua, Fla.

[73] Assignee: Heat Pipe Technology, Inc., Alachua, Fla.

[21] Appl. No.: 873,023

[22] Filed: Apr. 24, 1992

[51] Int. Cl.[5] ..... F25B 47/02

[52] U.S. Cl. ..... 62/81; 62/278

[58] Field of Search ..... 62/81, 277, 278

[56] References Cited

U.S. PATENT DOCUMENTS

| | | | |
|---|---|---|---|
| 2,526,032 | 10/1950 | La Porte | 62/81 |
| 2,801,524 | 8/1957 | Fifield | 62/278 X |
| 3,064,445 | 11/1962 | Gerteis | 62/149 |
| 3,343,375 | 6/1965 | Quick | 62/81 |
| 3,736,763 | 6/1973 | Garland | 62/85 |
| 3,978,684 | 9/1976 | Taylor | 62/324 |
| 3,985,182 | 10/1976 | Hara et al. | 165/32 |
| 4,102,151 | 7/1978 | Kramer et al. | 62/278 |
| 4,402,188 | 9/1983 | Skala | 62/56 |
| 4,420,943 | 12/1983 | Clawson | 62/81 |
| 4,646,537 | 3/1987 | Crawford | 62/238.6 |
| 4,646,539 | 3/1987 | Taylor | 62/278 |
| 4,785,640 | 11/1988 | Naruse | 62/196.4 |
| 4,798,059 | 1/1989 | Morita | 62/278 X |
| 4,827,733 | 5/1989 | Dinh | 62/305 |
| 4,962,647 | 10/1990 | Kuwahara | 62/156 |
| 4,977,953 | 12/1990 | Yamagishi et al. | 165/10 |

FOREIGN PATENT DOCUMENTS

| | | | |
|---|---|---|---|
| 764736 | 1/1957 | United Kingdom | 62/277 |

*Primary Examiner*—William E. Tapolcai

*Attorney, Agent, or Firm*—Foley & Lardner

[57] ABSTRACT

A passive defrost system uses a heat-exchanger/storage defrost module containing a thermal storage material such as a phase change material to capture and store low grade, waste heat contained in the liquid refrigerant line of a refrigeration system. The waste heat is stored during normal operation. Upon shut down of the refrigeration system, the stored heat in the defrost module is released by an automatic device for defrosting the evaporator. The preferred embodiment of this passive defrost system includes the defrost module and some device to transfer heat from the defrost module to the evaporator, preferably in the configuration of a gravity heat pipe. Since waste heat is taken out of the liquid refrigerant line, the efficiency of the refrigeration system is improved, and no additional energy is needed for the defrost operation.

9 Claims, 2 Drawing Sheets

PASSIVE DEFROST SYSTEM USING WASTE HEAT

BACKGROUND OF THE INVENTION

A wide variety of heating refrigeration and air conditioning systems are known which employ an evaporator, a condenser, an expansion valve or capillary tube, and a compressor. In such systems, low pressure refrigerant is compressed by the compressor and leaves the compressor as a vapor at an elevated pressure, and then condenses in the condenser, resulting in a transfer of heat to the environment surrounding the condenser. High pressure liquid then passes through an expansion valve in which some of the liquid refrigerant flashes into vapor. The remaining fluid is vaporized in the low pressure evaporator, resulting in a transfer of heat to the evaporating refrigerant from the environment. The refrigerant vapor is then drawn into the compressor, and the cycle begins again.

In some applications, the refrigerant may be cooled in the evaporator to a temperature which results in the formation of ice on the external surfaces of the evaporator. For example, the condenser of a heat pump typically forms an indoor coil of a system, and the evaporator forms an outdoor coil which extracts heat from the ambient air. During the heating cycle, ice may build up on the outdoor coil as water condenses on the coil because the temperature of the refrigerant in this coil is substantially below the freezing point of water. Accumulated ice may act as an insulator and provide a thermal barrier which interferes with heat transfer between the refrigerant in the evaporator and the outside environment. This in turn results in a significant decrease in the efficiency of the heat pump.

In order to avoid or at least inhibit this decrease in efficiency, procedures have been proposed to defrost the outdoor coils of heat pumps at regular intervals. Defrosting is typically performed by one of two procedures, both of which require the expenditure of substantial amounts of energy.

According to the first procedure, a resistive heating element is connected to the evaporator and is activated and deactivated as required to effect the defrost operation. While such external heat sources effectively defrost the evaporator, they are complicated construct, install, and control. In addition, they tend to be very energy intensive and in turn would decrease the efficiency of the heat pump.

The second common procedure for defrosting the evaporator of a heat pump involves the reversal of the heat pump cycle such that the flow refrigerant is reversed, and the evaporator becomes the condenser of the system, thereby melting the ice on the exterior surfaces of the outdoor coil. With this method, the heat within the structure being serviced by the heat pump is actually pumped to the outside, thus actually cooling the structure. Accordingly, a backup heat source such as an electric resistive heater must be employed to maintain the temperature within the structure during the defrost operation. Thus, this procedure, like the first defrost procedure, also requires the expenditure of additional energy to compensate for undesirable cooling resulting from the defrost operation.

Attempts have been made to eliminate or at least alleviate some of the disadvantages of traditional defrost procedures. One such procedure is discussed in U.S. Pat. No, 4,420,943, which issued to Lawrence G.

Clawson on Dec. 20, 1983. This procedure employs a thermal mass which is located in parallel with a condenser and which receives compressed refrigerant from a compressor. The compressed refrigerant transfers heat to the thermal mass which stores the heat for a subsequent defrost operation. During the defrost operation, the compressor is deactivated and a solenoid valve is opened to fluidly connect the thermal mass to the outlet of the evaporator in bypass of the compressor. With this bypass valve open, the pressures of the evaporator and the condenser equalize to an intermediate pressure. An inventory of refrigerant in contact with the thermal mass boils in the reduced pressure, thereby drawing heat from the thermal mass. The now vaporized refrigerant flows through the bypass valve to the evaporator and condenses in the relatively cool environment, thereby giving off heat to the evaporator which melts ice on the outside of the evaporator.

This defrosting procedure is more energy efficient than other prior art procedures. That is, neither the compressor nor any external heating element need be activated to effect the defrost operation. Moreover, since most of the heat of this defrost system is supplied by the thermal mass, this system does not require the addition of an auxiliary heating device to restore heat removed from the indoor space during the defrost process.

However, this passive defrost system suffers from several disadvantages. First, the thermal mass derives heat from the hot gas leaving the compressor making such heat unavailable for the space heating function. Second, the rapid pressure equalization between the indoor condenser and the outdoor evaporator results in some undesirable heat transfer from the surroundings to the condenser. Moreover, because the thermal mass is located in parallel with the condenser, it does not in any way facilitate cooling of the liquid refrigerant being circulated through the system during the normal thermodynamic cycle taking place while the compressor is operating, and thus does not increase the overall efficiency of the device during normal operation. In addition, the provision for a certain inventory of liquid refrigerant in the thermal mass is difficult to determine because of the variable amount of heat necessary to defrost the evaporator at different conditions. As for example, one pound of refrigerant R-22 will provide only about 70 BTUs of heat as it evaporates from the thermal mass and condenses in the evaporator, such amount is only sufficient to melt about half a pound of ice. Since several pounds of ice can form on the evaporator of a typical residential heat pump, the amount of refrigerant to be inventoried in the thermal mass can become impractically large and in turn create refrigerant charge balancing problems for the heat pump system.

SUMMARY OF THE INVENTION

It is therefore an object of this invention to provide a system for passively defrosting the evaporator of a heat transfer system, without removing heat from the ambient environment surrounding any part of the system, so that no external energy is required to provide the defrost operation or to restore heat removed by the defrosting operation.

Another object of the invention is to provide a heating or refrigeration system having a passive defrost system which enhances the efficiency of the entire system during normal operation by lowering the temperature of the condensed refrigerant before evaporation.

Still another object of the invention is to provide a passive defrost system which is relatively compact and which can be easily retrofitted into existing refrigeration of heating systems.

According to one aspect of the invention, these and other objects are achieved by providing a system comprising an evaporator having an inlet and an outlet port, a heat-exchange/storage defrost module which includes a heat-exchanger circuit enclosed in a canister containing a thermal mass such as a phase-change material. The defrost module is located on the liquid line of the refrigeration system between the outlet of the condenser and the expansion device, such that the liquid refrigerant will transfer heat to the phase change material. Piping and valves are provided which establish a flow of refrigerant from the defrost module to the inlet and outlet of the evaporator to establish flow of refrigerant between the evaporator and defrost module during a passive defrost operation.

Preferably, a compressor is provided which, when activated, pumps refrigerant from the condenser through the defrost module and the evaporator. The connection piping preferably comprises two pressure responsive valves which are located between the module and the inlet and outlet of the evaporator. The valves are closed by the pressure generated by the compressor when the compressor is activated, and open when the compressor is deactivated to effect the passive defrost operation by permitting refrigerant flow through the defrost module valves and evaporator.

In order to provide efficient heat transfer, the heat storage medium may comprise a phase change material which exchanges heat with the refrigerant.

In accordance with another preferred aspect of the invention, the defrost module and the outdoor coil form a gravity heat pipe.

Another object of this invention is to provide a method which includes the passive defrosting of a heating or refrigeration system.

In accordance with this aspect of the invention, this object is achieved through the provision of a method comprising the steps of condensing a refrigerant in a first heat exchanger, then cooling the refrigerant in a heat storage module located in series between the first heat exchanger and a first port of a second heat exchanger, the module having a heat storage medium located therein which exchanges heat with the refrigerant and stores the heat removed from the refrigerant, and then evaporating the refrigerant in the second heat exchanger by conveying the refrigerant through an expansion device to the second heat exchanger from the first port to a second port. Also provided is the step of passively defrosting the second heat exchanger by permitting the refrigerant to flow through the second heat exchanger from the second port to the first port, through the module, and back to the second port of the second heat exchanger by gravity or with the use of a pump.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being made to the accompanied drawings in which like reference numerals represent like parts throughout, and in which.

DETAILED DESCRIPTION OF THE PREFERRED EMBODIMENTS

In accordance with the invention, a heat exchange system is provided having a passive defrost system which operates automatically upon deactivation of the compressor. During normal operation of the heat exchange system, the efficiency of the system is increased by removing heat from the condensed refrigerant prior to evaporation of the refrigerant in the evaporator coil and storing the removed heat in a heat exchange/storage module. During the defrost mode, the heat stored in the module automatically defrosts the cooling coil.

Figure 1:
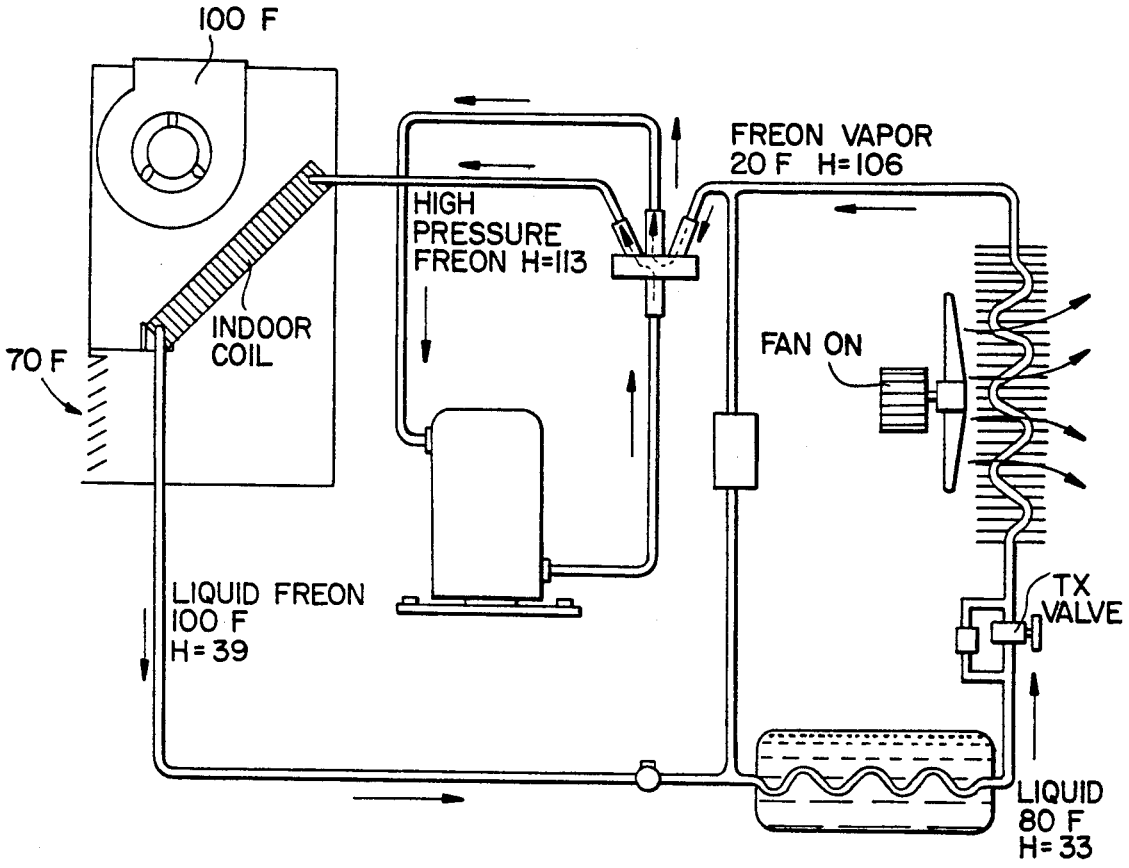
FIG. 1 schematically illustrates a heat pump constructed in accordance with a preferred embodiment of the invention with the heat pump operating in a normal heating mode.
Figure 2:
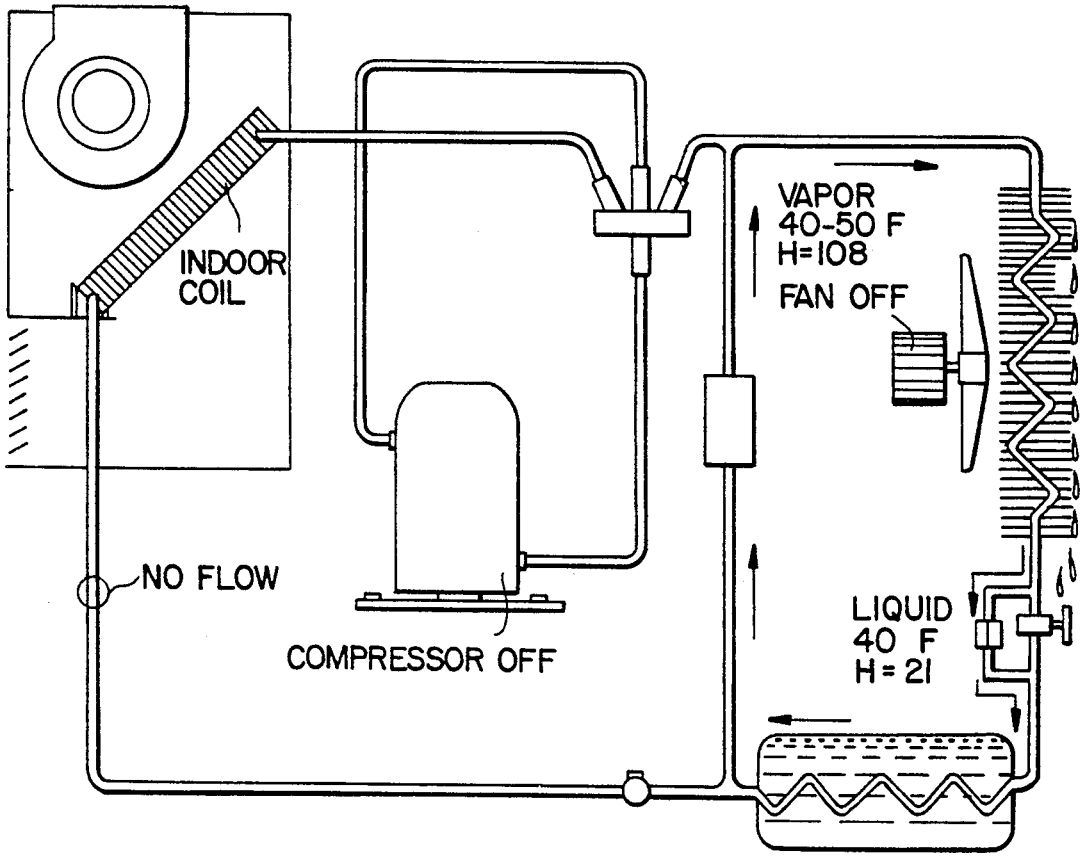
FIG. 2 illustrates the heat pump of FIG. 1 being operated in a defrost mode.

Referring to FIGS. 1 and 2, a heat pump 10 has as its primary components a compressor 20, an indoor coil 30 acting as a condenser during a normal heating operation, a heat exchange/storage defrost module 40, and an outdoor coil 50 acting as an evaporator during normal operation of the heat pump. Also provided are an expansion valve 60 and a flow reversing valve provided in the form of a 4-way valve 80, the construction and operation of each of which is well known in the art and thus will not be described in further detail. Two pressure responsive valves 70 and 100 are also provided, and initiate a passive defrost operation by allowing flow of refrigerant through outdoor coil 50 during a passive defrost operation.

Each of the indoor coil 30 and the outdoor coil 50 may comprise any conventional heat exchanger device adapted to provided heat transfer between refrigerant such as "Freon" flowing through the interior of the heat exchanger and the ambient atmosphere located on the outside of the heat exchanger. During normal operation of a heat pump, the indoor coil functions as a condenser and supplies heat to the internal environment of a structure, and the outdoor coil acts as an evaporator in which the liquid refrigerant is vaporized by heat from the ambient atmosphere.

Normal operation of the heat pump 10 will now be described in more detail with reference to FIG. 1. To effect a normal heating operation, the compressor 20 is activated to deliver high pressure vapor refrigerant from an outlet 22, through a line 24, 4-way valve 80, a line 25,, and into an inlet port 36 of indoor coil 30. Condensation of the refrigerant in coil 30 transfers heat to air which is drawn through the coil 30 from a suitable supply vent 38 by a blower 39, which then returns the heated air to the interior of the structure being heated. The condensed refrigerant then is conveyed out of condenser 30 via an outlet port 32, and through a line and module 40.

As can be seen in the drawings, module 40 is located in series between the indoor coil 30 and the outdoor coil 50. Of course, a series connection does not require that no other elements can be provided between these elements, but only means that, during normal operation, refrigerant is conveyed through each of these devices.

In module 40, heat is removed from the refrigerant and stored in a heat storage medium 45 provided in the module. While any of a wide variety of heat storage media could be used for this purpose, heat transfer and storage is preferably performed via a phase change material with a low melting point such as a material from the paraffin family or one of many known eutectic salts. Phase change materials are preferred because of their ability to store large amounts of heat in a relatively small space.

During this operation, the warm liquid refrigerant melts the phase change material and gives up an amount of low grade heat equivalent to 5% to 8% of the system capacity. Thus, a typical three ton heat pump operating at 36,000 BTUh can store about 2,200 BTUh (equivalent to 630 watt.hour of heat) in module 40. This heat is available at temperatures from between 32 to 100 F., depending on the phase change material used. Thus, while this heat may not be at a sufficiently high temperature to heat the structure, it is quite suitable for defrosting the outdoor coil 50 at 32 F. In addition to storing heat for defrosting, the module 40 significantly enhances the efficiency of the heat pump 10 by lowering the temperature of the refrigerant before evaporation.

After leaving the module 40, the cooled liquid refrigerant is then conveyed through a line 46 and expansion valve 60 before entering a first port 52 of outdoor coil 50. As is typical of most heat pumps, evaporation within the coil 50 is enhanced by providing a fan 56 which forces air through the coil, thereby increasing the heat transfer efficiency of the coil. Preferably, fan 56 is controlled so as to operate only when the compressor 20 is operating. To this end, fan 56 can be wired into the control circuit for the compressor so that it is activated and deactivate with the compressor.

After leaving second port 54 of evaporator 50, the vaporized refrigerant travels through a line 58, 4-way valve 80, a line 26, and into inlet 28 of compressor 20, where the refrigerant will be compressed, and the cycle will begin anew. During this operation, valves 70 and 100 will be maintained in the closed position illustrated in FIG. 1 under the pressure generated by compressor 20 and thus will prevent refrigerant flow through line 102.

Valves 70 and 100 can comprise any suitable valve, such as a 2-way solenoid operated valve or a poppet type pressure responsive valve. However, each of valves 70 and 100 preferably comprises a pressure responsive valve having a high pressure port, a tube having a low pressure port, a spring which surrounds the tube, and a sealing disk or block. The spring normally biases the sealing disk to its open position to allow the free flow of fluid through the valve. However, when pressurized fluid is introduced into the valve through the high pressure port, the sealing disk compresses the spring and seals the tube leading to the low pressure port, thereby preventing the flow of pressurized fluid through the valve. A valve of this type is disclosed in U.S. Pat. No. 4,827,733, issued to Khanh Dinh on May 9, 1989, the subject matter of which is hereby incorporated by reference.

Thus, during normal operation of the heat pump in which valve 70 and valve 100 assume the positions illustrated in FIG. 1 and "Freon" is used as the refrigerant, high pressure vaporized "Freon", having a relatively high enthalpy h of, e.g., 113 BTU.lb. is pumped to the inlet 36 of condenser 30, and is condensed in the indoor coil forming the condenser 30, thereby heating the air flowing through the coil. The liquid "Freon", having a temperature of, e.g., 100 F. and an enthalpy of, e.g., 39 BTU.lb. then flows through module 40 where some of the waste heat of the refrigerant is removed, thereby increasing the efficiency of the overall system by lowering the temperature and enthalpy of the refrigerant to, e.g., 80 F. and 33 BTU.lb. respectively. The liquid refrigerant then passes through line 46 and expansion valve 60 and then through evaporator 50, in which air being forced through the evaporator by fan 56 transfers heat to the refrigerant to vaporize the refrigerant. The vaporized "Freon" refrigerant, having a temperature of, e.g., 20 F. and an enthalpy of, e.g., 106 BTU. lb, is then conveyed out of the second port 54 of outdoor coil 50 and is conveyed back to the compressor where the cycle begins anew.

When a cycle such as the one described above takes place under relatively cold temperatures of, e.g., 32 F., the relatively cold refrigerant in outdoor coil 50 freezes the water which condenses on the coil, thereby causing a build-up of ice on the coil. This ice is melted and removed when the heat pump is not being used for heating in a passive defrost operation taking place as follows.

When compressor 20 is deactivated, fan 56 will also be deactivated. In addition, each of valves 70 and 100 will assume an open position due to the absence of fluid pressure at the high pressure inlet port. Accordingly, the heat pump 10 will assume the operating state illustrated in FIG. 2. Under these conditions, the outdoor coil 50 and the module 40 will preferably act as the condensing and evaporating ends of a gravity heat pipe. Gravity heat pipes are, per se, well known, and are disclosed, e.g., in U.S. Pat. No. 4,827,733. In this heat pipe, refrigerant in module 40 will receive heat from the phase change material stored in the module and will boil to form a vaporized refrigerant. This vaporized refrigerant typically has a temperature of between 40 and 50 F. and an enthalpy of about 108 BTU. lb. The vaporized refrigerant rises up through line 102 and valve 100 and into outdoor coil 50. The refrigerant condenses in this coil, thereby transferring heat to the ice built up on the outside of the coil and melting of the ice. The liquid refrigerant now has a reduced enthalpy and temperature, e.g., 21 BTU.lb and 40 F. and drains out of the outdoor coil 50 and flows through valve 70 and line 46 and into module 40. This liquid refrigerant then receives additional heat from the phase change material 45 and boils, and the cycle begins anew.

When the compressor 20 is activated to resume a normal heating cycle, valves 70 and 100 will assume their closed positions and fan 56 will be activated so that all of the components of the system 10 assume the positions illustrated in FIG. 1.

During the defrost cycle, flow of refrigerant to the outlet port 32 of indoor coil 30 is prevented by the higher temperature of coil 30 which creates a higher pressure in coil 30 than in line 102, and/or by a solenoid valve or any other device installed in line 34 to prevent such occurrence. In addition, second port 54 of outdoor coil 50 offers less resistance than 4-way valve 80 connected to compressor 20, which usually has internal one way valves or other check valve to prevent backward flow of refrigerant, so the refrigerant will neither flow back to indoor coil 30 nor to 4-way valve 80. Thus,, the indoor components and compressor are automatically isolated from the outdoor components upon deactivation of the compressor and initiation of the passive defrost operation and are not affected by the defrost operation.

Of course, the components of the passive defrost device 40, 50, 100 need not take the positions illustrated in the drawings. For example, both the coil 50 and the module 40 could be inclined with the horizontal in a manner similar to which indoor coil 30 is inclined. However, if the system is designed to function as a gravity heat pipe, it is essential for proper operation of the gravity heat pipe that the evaporator coil 50 be located higher than the module 40. In case the liquid return in the heat pipe mechanism is not by gravity, other devices such as a capillary wick or a small liquid refrigerant pump can be used. In addition, refrigerant need not flow in the direction illustrated in FIG. 2 during the defrost operation, but could flow into the evaporator coil 50 through the line 46 and the valve 70.

Since the passive defrost system described above uses low temperature waste heat and is totally passive, the energy savings of the system can pay for the system in a relatively short time. For example, for a typical residential three ton heat pump system, it is estimated that production and installation of the module 40, Valves 70 and 100 will cost approximately $100. This cost is about the same as the cost to provide a 10 KW back-up heater and the associated controls.

The typical defrost system requiring reversal of the compressor requires 5 KW of energy to operate the compressor and 10 KW of energy to operate the back-up heater required to replace the heat removed from the structure during the defrost cycle. This operation results in a system which uses 15 kw of electricity during a defrost operation. If this typical system were to be provided with the passive defrost system of the instant invention and operates 2,000 hours per winter with the defrost system operating 5% of the time, the system would save 100 hours of active defrost time of operation which would otherwise be provided by a 15 kwh active defroster, thereby saving 1,500 kwh per year. Thus, at an electricity cost of $0.08 per kwh, the passive defrost system will save about $120 in its first year of operation, paying for itself in less than a year. It is also estimated that even if considerably higher expenses are incurred retrofitting a passive defrost system into an existing system, the system will still pay for itself in less than three years.

Of course, these energy savings do not even take into account the energy savings which occur during normal operation of the heat pump in which the refrigerant flowing through the module is cooled before being evaporated in the outdoor coil. In fact, total energy savings for all winter heating operations in a humid climate are expected to be between 20% and 30%, depending on the defrost procedure being replaced.

In addition to being totally passive and thus requiring no energy, the passive defrost system is fully automatic, is relatively compact, and requires no maintenance. This is in sharp contrast to most defrost systems currently in use, which are relatively expensive to produce, maintain, and operate.

Although the passive defrost system has been described only in conjunction with a heat pump, it should be understood that this system is equally applicable to commercial applications such as supermarket display cases and freezers, ice-makers, walk-in freezers and coolers, beverage coolers, absorption type air-conditioning systems, and other residential refrigeration systems operating below freezing point of water. In fact, the passive defrost system of the present invention can be used in virtually any existing residential, commercial, or industrial refrigeration or heat pump system in which defrost is required, and can be added at little cost to any existing refrigeration or heat pump system. In addition, due to its simplicity and compact size, production and installation of the passive defrost system of the present invention are actually easier and less expensive than that of many existing defrost systems.

What is claimed is:

1. A heat pump comprising:

(A) an indoor coil having inlet and outlet ports;

(B) an outdoor coil having a first port which is connected to said outlet port of said indoor coil and having a second port;

(C) a heat exchanger/storage defrost module which is located in series between said outlet port of said indoor coil and said first port of said outdoor coil and which has a heat exchange medium located therein which exchanges heat with refrigerant flowing through said defrost module.

(D) a compressor which, when activated, pumps refrigerate out of said outlet port of said indoor coil, through said defrost module, through said outdoor coil; and (E) pressure responsive values which are located between said defrost module and said outdoor coil, which are closed by the pressure generated by said compressor when said compressor is activated, and which open when said compressor is deactivated to effect said passive defrost operation by permitting refrigerant flow between said outdoor coil and said defrost module.

2. The system of claim 1, wherein said outdoor coil is located above said defrost module, and wherein said defrost module and said outdoor coil form a gravity heat pipe.

3. The system of claim 1, wherein said outdoor coil and said defrost module form a heat-exchange loop having a small pump which circulates refrigerant between said outdoor coil and said defrost module.

4. A system comprising:

(A) a condenser having a outlet port;

(B) an evaporator having an inlet port which is connected to said outlet port of said condenser and having a second outlet port;

(C) a heat exchanger/storage defrost module which is in series with said outlet port of said condenser and which has a heat storage medium located therein which exchanges heat with refrigerant flowing through said defrost module; and (D) a device which establishes a flow of refrigerant between said defrost module and said evaporator during a passive defrost operation such that said evaporator is passively defrosted;

(E) a compressor; and (F) means for isolating said heat exchanger/storage defrost module and said evaporator from said compressor and said condenser;

wherein when said compressor is activated said compressor, said condenser, said evaporator, and said heat exchanger/storage defrost module form a refrigeration circuit, and when said compressor is deactivated, said isolating means isolates said evaporator and said heat exchanger from said compressor and said condenser thereby creating a defrost circuit including said evaporator and said heat exchanger/storage defrost module which passively defrosts said evaporator.

5. The system of claim 4, wherein said isolating means includes a four-way valve.

6. The system of claim 4, wherein said isolating means automatically isolates said evaporator and said heat exchanger/storage defrost module from said compressor and said condenser when said compressor is deactivated.

7. A method comprising the steps of:

(A) providing a refrigeration circuit including a compressor; an evaporator circuit, a condenser circuit, and a heat exchanger/storage defrost module, said condenser circuit including a condenser and said evaporator circuit including an evaporator;

(B) passing liquid refrigerant from said condenser to said heat exchanger/storage defrost module and then from said heat exchanger/storage defrost module to said evaporator;

(C) utilizing said heat exchanger/storage defrost module to remove heat from said liquid refrigerant supplied to said heat exchanger/storage defrost module from said condenser;

(D) storing said removed heat in said heat exchanger/storage defrost module;

(E) deactivating the operation of said compressor and concurrently and automatically isolating said evaporator circuit from said condenser circuit so that said evaporator and said heat exchanger/storage defrost module form a defrost circuit which is isolated from said condenser circuit;

(F) allowing said removed heat which is stored in said heat exchanger/storage defrost module to be transferred into liquid refrigerant in said defrost circuit; and (G) passively defrosting said evaporator utilizing said defrost circuit.

8. A system comprising:

(A) a condenser having an outlet port;

(B) an evaporator having an inlet port which is connected to said outlet port of said condenser and having a second outlet port;

(C) a heat exchanger/storage defrost module which is in series with said outlet port of said condenser and which has a heat storage medium located therein which exchanges heat with refrigerant flowing through said heat exchanger/storage defrost module;

(d) a device which establishes a flow of refrigerant between said heat exchanger/storage defrost module and said evaporator during a passive defrost operation such; and (E) a compressor which, when activated, pumps refrigerant from said outlet port of said condenser through said heat exchanger/storage defrost module and said evaporator;

wherein said device comprises pressure responsive valves which are located between said defrost module and said evaporator, which are closed by the pressure generated by said compressor when said compressor is activated, and which open when said compressor is deactivated to effect a passive defrost operation by permitting refrigerant flow between said evaporator and said defrost module.

9. A system comprising:

(A) a condenser having an outlet port;

(B) an evaporator having an inlet port which is connected to said outlet port of said condenser and having a second outlet port;

(C) a heat exchanger/storage defrost module which is in series with said outlet port of said condenser and which has a heat storage medium located therein which exchanges heat with refrigerant flowing through said heat exchanger/storage defrost module;

(D) a device which establishes a flow of refrigerant between said heat exchanger/storage defrost module and said evaporator during a passive defrost operation;

(E) a compressor which, when activated, pumps refrigerant from said outlet port of condenser, through said defrost module and said evaporator, and (F) a fan which, when activated, forces air through said evaporator, said fan being activated when said compressor is activated and deactivated when said compressor is deactivated.

* * * * *